US008863717B2

(12) United States Patent
Metzger et al.

(10) Patent No.: US 8,863,717 B2
(45) Date of Patent: Oct. 21, 2014

(54) INTAKE DEVICE OF AN INTERNAL COMBUSTION ENGINE

(75) Inventors: Michael Metzger, Waiblingen (DE); Calogero Colletto, Filderstadt (DE)

(73) Assignee: Mann+Hummel GmbH, Ludwigshafen (DE)

( * ) Notice: Subject to any disclaimer, the term of this patent is extended or adjusted under 35 U.S.C. 154(b) by 28 days.

(21) Appl. No.: 13/524,051

(22) Filed: Jun. 15, 2012

(65) Prior Publication Data

US 2012/0247416 A1 Oct. 4, 2012

Related U.S. Application Data

(63) Continuation of application No. PCT/EP2010/069752, filed on Dec. 15, 2010.

(51) Int. Cl.

| | |
|---|---|
| ***F02M 35/10*** | (2006.01) |
| ***F02M 35/16*** | (2006.01) |
| ***F02M 35/108*** | (2006.01) |
| *F02M 35/112* | (2006.01) |
| *F02M 35/024* | (2006.01) |

(52) U.S. Cl.

CPC ..... *F02M 35/161* (2013.01); *F05C 2225/08* (2013.01); *F02M 35/10347* (2013.01); *F02M 35/112* (2013.01); *F02M 35/10144* (2013.01); *F02M 35/10013* (2013.01); *F02M 35/024* (2013.01); *F02M 35/10321* (2013.01); *F02M 35/108* (2013.01)

USPC ..... 123/184.21

(58) Field of Classification Search

CPC ..... F02M 35/10321; F02M 35/10144; F02M 35/112; F02M 35/10347; F05C 2225/08

USPC ..... 123/184.21

See application file for complete search history.

(56) References Cited

U.S. PATENT DOCUMENTS

| | | | | |
|---|---|---|---|---|
| 2006/0168920 | A1 * | 8/2006 | Cassell et al. | 55/311 |
| 2010/0186354 | A1 * | 7/2010 | Braithwaite | 55/385.3 |

FOREIGN PATENT DOCUMENTS

| | | | |
|---|---|---|---|
| DE | 4408097 | A1 | 9/1995 |
| DE | 19926135 | A1 | 12/2000 |
| DE | 19951408 | A1 | 5/2001 |
| DE | 102004036083 | A1 | 2/2006 |
| DE | 102006005514 | A1 | 11/2007 |
| DE | 102008036913 | B3 | 11/2009 |
| JP | 2008232111 | A | 10/2008 |

OTHER PUBLICATIONS

WIPO Office Action of PCT/EP 2010/069752 (WO2011083001 A1) of Apr. 13, 2011.

* cited by examiner

*Primary Examiner* — Lindsay Low
*Assistant Examiner* — Charles Brauch
(74) *Attorney, Agent, or Firm* — James Hasselbeck

(57) ABSTRACT

An intake device of an internal combustion engine has primary and secondary intake lines for aspirating primary and secondary combustion air, respectively. The primary intake line opens into a primary inlet chamber and the secondary intake line opens into a secondary inlet chamber of a filter housing. In comparison to the primary intake line, the secondary intake line has a configuration such that, in normal engine operation, a flow capacity of the secondary intake line, in comparison to a flow capacity of the primary intake line, is so minimal that secondary combustion air aspirated through the secondary intake line has a negligible effect on the performance of the internal combustion engine. When the primary intake line is closed, the flow capacity of the secondary intake line suffices to supply the internal combustion engine with a minimum combustion air mass flow required for operating the internal combustion engine.

6 Claims, 4 Drawing Sheets

INTAKE DEVICE OF AN INTERNAL COMBUSTION ENGINE

CROSS-REFERENCE TO RELATED APPLICATIONS

This application is a continuation application of international application No. PCT/EP2010/069752 having an international filing date of 15 Dec. 2010 and designating the United States, the International Application claiming a priority date of 15 Dec. 2009, based on prior filed German patent application No. 10 2009 058 161.8, the entire contents of the aforesaid international application and the aforesaid German patent application being incorporated herein by reference.

BACKGROUND OF THE INVENTION

The invention concerns an intake device of an internal combustion engine, in particular of a motor vehicle, with a primary intake line and a secondary intake line for aspirating combustion air.

DE 10 2006 016 433 A1 discloses an intake device for an internal combustion engine of a motor vehicle with a primary intake line and a secondary intake line. An intake port of the primary intake line for aspirating external air is located at the exterior of the motor vehicle. An intake port of the secondary intake line is arranged in the engine compartment. A switch valve is provided for switching between the primary intake line and the secondary intake line. In order to prevent water from entering through the primary intake line, the switch valve is actuated when driving off-road. Either the primary intake line or the secondary intake line is thus opened in order to aspirate combustion air. In particular in winter or in cold regions, it may happen that even during normal operation of the motor vehicle on roads, i.e., not during off-road operation, the primary intake line may become closed off (clogged), in particular by snow or ice. This cannot be detected by the intake device of the prior art, and the internal combustion is then no longer supplied with sufficient combustion air through the primary intake line in order to ensure operation of the internal combustion engine. The engine "dies".

The invention has therefore the object to design an intake device of the aforementioned kind in such a way that operation of the internal combustion engine is ensured in a simple and reliable way even upon closure (clogging) of the primary intake line.

SUMMARY OF THE INVENTION

In accordance with the invention, this is achieved in that the primary intake line opens into a primary inlet chamber of an air filter housing, the secondary intake line opens into a secondary inlet chamber of the air filter housing, and the secondary intake line, in comparison to the primary intake line, is designed with respect to its configuration (shape and/or size) such that, in normal operation of the internal combustion engine, the flow capacity of the secondary intake line in comparison to the flow capacity of the primary intake line is so minimal that the secondary combustion air aspirated through the secondary intake line has a negligible or insignificant effect on the performance of the internal combustion engine and that, in case of closure (clogging) of the primary intake line, the flow capacity of the secondary intake line is sufficient in order to supply the internal combustion engine with a minimal combustion air mass flow that is required for operation.

According to the invention, the secondary intake line is thus designed such that, upon closure or clogging of the primary intake line, in particular in case of snow deposits, it is used as a bypass line for aspirating secondary combustion air without this requiring a separate switch valve. The elimination of the switch valve has a positive effect on costs, wear, and reliability of the intake device. By eliminating the switch valve, it is also possible to essentially freely select the location for the secondary intake port of the secondary intake line. In the intake device that is disclosed in the prior art, the secondary intake port must be arranged either directly at an air filter housing or additional constructive measures are required, in particular, additional lines must be laid. In normal operation, the primary intake line and the secondary intake line are open for aspirating combustion air so that the properties, in particular temperature and/or moisture, of the total combustion air supplied to the internal combustion engine, are determined by the mixture of the primary combustion air of the primary intake line and the secondary combustion air of the secondary intake line. Based on the configurational differences of the primary intake line and the secondary intake line in regard to the configuration (shape and/or size), the decisive proportion of the total combustion air is aspirated through the primary intake line in normal operation. The properties of the total combustion air supplied to the internal combustion engine is determined by the primary combustion air. The effect of the relatively small air mass flow of the secondary combustion air is so small that it is negligible. The primary intake line is designed such that it supplies to the internal combustion engine primary combustion air with properties that are optimal for the combustion process and thus for the performance of the internal combustion engine. Through the secondary intake line, on the other hand, secondary combustion air is supplied that has properties that must not be optimal for the combustion process but, in case of closure (clogging) of the primary intake line, are sufficient for maintaining operation of the internal combustion engine. Preferably, the primary intake line and the secondary intake line open at the raw air side (unfiltered air side) of a filter element into the filter housing. By means of the filter element, the aspirated combustion air is filtered. Since the secondary intake line opens into a secondary inlet chamber of the air filter housing, the properties of the total combustion air that is supplied to the internal combustion engine in normal operation, but also in case of clogging of the primary intake line, are optimized in respect to the combustion. The division of the raw air area into a primary inlet chamber and a secondary inlet chamber prevents that snow, ice or dirt will reach the area of the secondary air intake and block the filter element. As a result of the design of the secondary intake line and the primary intake line that are matched to each other in combination with the primary inlet chamber and the secondary inlet chamber, it is also possible to reduce or eliminate underpressure that is generated in the air filter housing upon clogging of the primary intake line, in particular by snow, ice and/or dirt, by means of the secondary intake line. In this way, it can be prevented that snow, ice and/or dirt can be sucked in from the primary intake line into the air filter housing and can cause soiling or damage of the filter element.

In an advantageous embodiment, a secondary intake port of the secondary intake line can be arranged so as to be protected from external influences that could cause clogging of the secondary intake line, in particular snow, water and/or dirt. In this way, an emergency operation of the internal combustion engine is at least possible that is substantially independent of external influences. The secondary intake port can be arranged in particular in an engine compartment that is protected anyway.

Advantageously, the secondary intake port can be arranged at a location where the secondary combustion air that is sucked in at this location has a temperature greater than 0 degrees Celsius, in particular approximately 80 degrees Celsius, which temperature is sufficient to prevent loading of the secondary intake line with snow and/or ice. Such temperatures exist In particular in the engine compartment in operation of the internal combustion engine.

Preferably, the configuration (shape and/or the size), in particular the length and/or the cross-section, of the secondary intake line can be predetermined such that in normal operation a secondary pressure loss in the secondary intake line in comparison to a total pressure loss in the intake device is so large that aspiration of secondary combustion air through the secondary intake line is nearly prevented. The pressure losses can be determined in a simple way and can be utilized for predetermining the configuration (shape and/or size) of the secondary intake line.

BRIEF DESCRIPTION OF THE DRAWING

Further advantages, features and details of the invention result from the following description in which an embodiment of the invention will be explained in more detail with the aid of the drawing. A person of skill in the art will consider the features, disclosed in combination in the drawing, the description, and the claims, expediently also individually and will combine them to other expedient combinations.

In the Figures, same elements are identified with the same reference characters.

DESCRIPTION OF THE PREFERRED EMBODIMENTS

Figure 1:
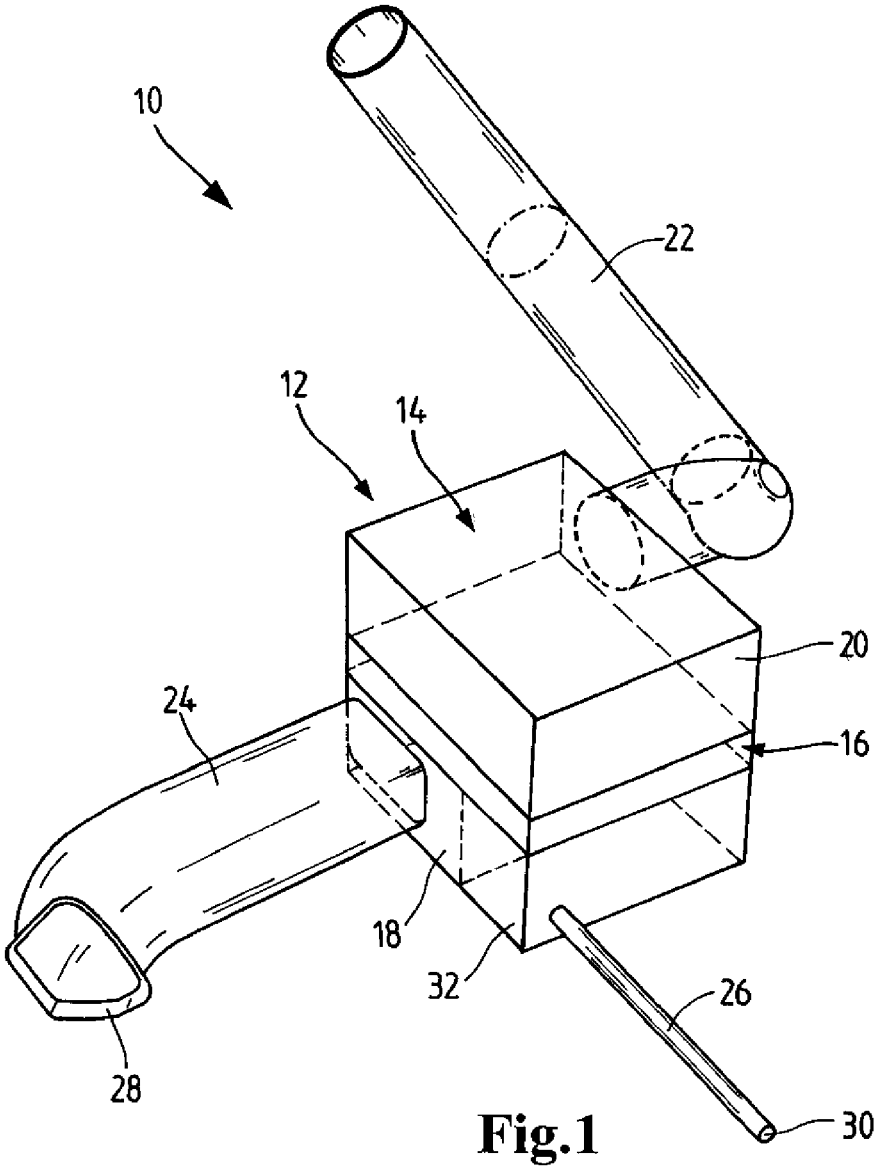
FIG. 1 shows an intake device with an air filter of an internal combustion engine of a motor vehicle with a primary intake line and a secondary intake line.

In FIG. 1, an intake device 10 for combustion air of an internal combustion engine, not illustrated, of a motor vehicle is shown. The combustion air supplied to the internal combustion engine is referred to in the following as the total combustion air in order to make a distinction to the other combustion air flows.

The intake device 10 comprises an air filter 12 with an air filter housing 14 in which a filter element 16 for filtration of the total combustion air is arranged. The filter element 16 comprises a filter medium of an isotropic porous material.

The filter element 16 separates a primary inlet chamber 18 at the raw air side (unfiltered air side) of the filter element 16 seal-tightly from an outlet chamber 20 at the clean air side (filtered air side). The primary inlet chamber 18 adjoins immediately the filter element 16.

A clean air (filtered air) line 22 extends from the outlet chamber 20 to the internal combustion engine.

The intake device 10 comprises a primary intake line 24 for aspirating primary combustion air and a secondary intake line 26 for aspirating secondary combustion air.

A primary intake port 28 of the primary intake line 24 is located outside of the motor vehicle so that possibly cool fresh air can be aspirated. With the fresh primary combustion air an optimal performance of the internal combustion engine is achieved. The primary intake line 24 opens directly into the primary inlet chamber 18.

A secondary intake port 30 of the secondary intake line 26 is arranged within the engine compartment so as to be protected from external influences, in particular snow, water and/or dirt, that might cause clogging of the secondary intake line 26. In the engine compartment, in general temperatures greater than 0 degrees Celsius exist when the internal combustion engine is operating, even in cold regions. At the secondary intake port 30, secondary combustion air is aspirated at a temperature of, for example, approximately 80 degrees Celsius. The aspirated hot air prevents loading of the secondary intake line 26 with snow and ice.

The secondary intake line 26 opens into a secondary inlet chamber 32 of the air filter housing 14 that is separated from the primary inlet chamber 18. The secondary inlet chamber 32 directly neighbors the chamber 18 at the raw side of the filter element 16. The hot secondary combustion air of the secondary intake line 26 first flows into the secondary inlet chamber 32. It is aspirated from here through the filter element 16 and filtered and then flows into the outlet chamber 20 from where it is supplied through the clean air line 22 to the internal combustion engine.

The secondary intake line 26 has a substantially smaller cross-section than the primary intake line 24 so that, in normal operation of the internal combustion engine, the flow capacity of the secondary intake line 26 in comparison to the flow capacity of the primary intake line 24 is so small that the aspirated hot secondary combustion air aspirated through the secondary intake line 26 has a negligible effect on the performance of the internal combustion engine. Infra, in connection with FIG. 3, it will be explained in more detail that, in normal operation, heating (caused by the secondary combustion air) of the total combustion air that is supplied to the internal combustion engine is so small that it is negligible. The configuration (shape and/or size) of the secondary intake line 26 depends on the operating properties of the internal combustion engine, in particular its performance characteristics and the demand of total combustion air. The length and cross-section of the secondary intake line 26 are matched to each other and to the flow capacity of the primary intake line 24 in such a way that, in normal operation, as shown schematically in FIG. 2, a secondary pressure loss dpsek in the secondary intake line 26 in comparison to a total pressure loss dptot in the intake line 10 is so large that intake of combustion air through the secondary intake line 26 is nearly prevented.

On the other hand, the dimensions of the secondary intake line 26 in comparison to the primary intake line 24 are selected such that in case of closure or clogging of the primary intake line 24, for example, in case of snow deposits, the flow capacity of the secondary intake line 26 is sufficient in order to supply the internal combustion engine with a minimum combustion air mass flow that is required for engine operation. This will be explained in more detail infra in connection with FIG. 4. By means of the secondary intake line 26, a vacuum or underpressure that may be generated upon closure of the primary intake line 24, in particular with snow, ice or dirt, in the air filter housing 14 can also be decreased or canceled. In this way, it can be prevented that snow, ice or dirt from the primary intake line 24 can be aspirated into the air filter housing 14 and can cause soiling or damage of the filter element 16.

Figure 2:
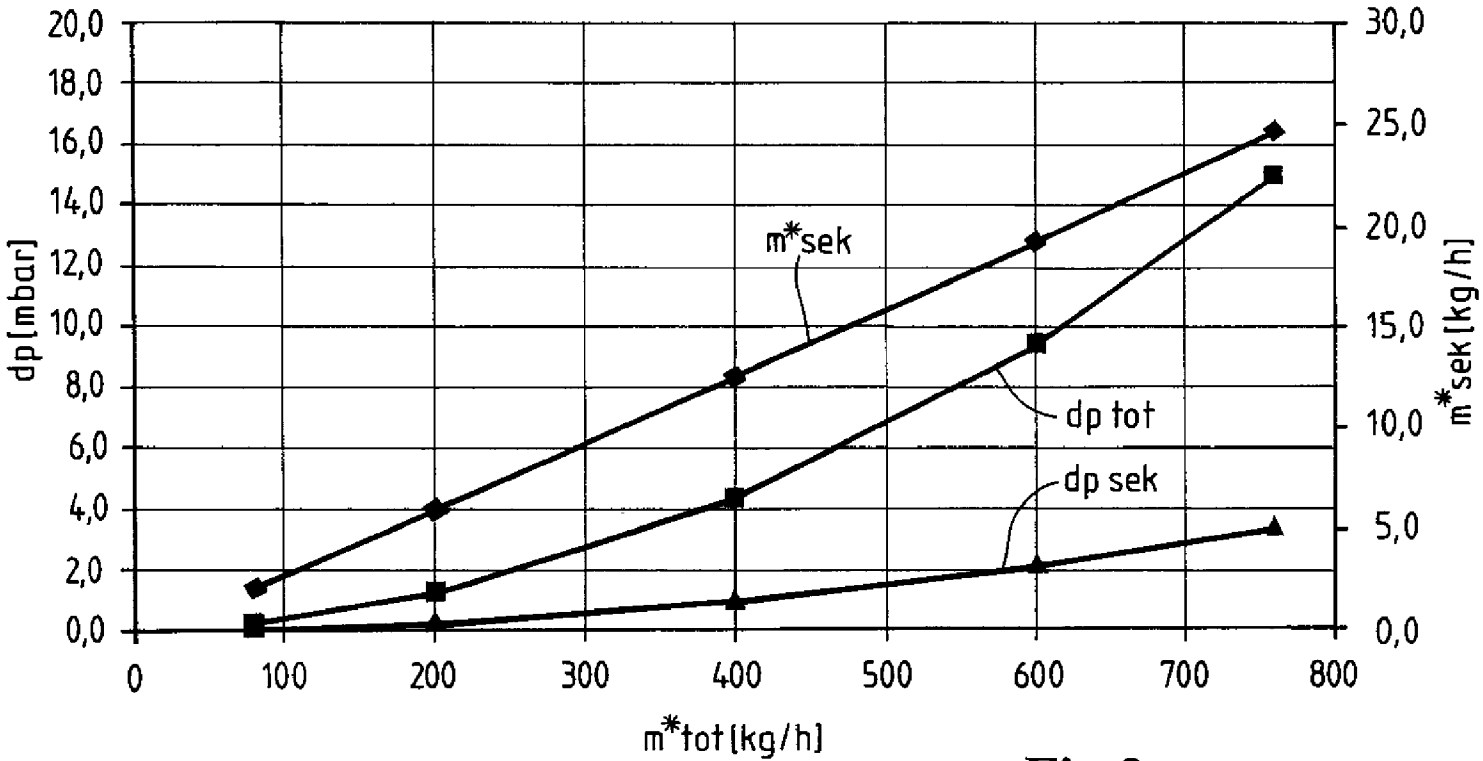
FIG. 2 shows schematically in a diagram total pressure loss in the intake device of FIG. 1, secondary pressure loss in the secondary intake line, and secondary air mass flow through the secondary intake line as a function of the total air mass flow through the intake device when the primary intake line is open.

The diagram of FIG. 2 shows in an exemplary fashion for an open primary intake line 24 the total pressure loss dptot (central curve) and the secondary pressure loss dpsek (lower curve) as a function of a total air mass flow m*tot through the intake device 10 at different partial load ranges of the internal combustion engine. The pressure losses dptot and dpsek are plotted in FIG. 2 to the left along the vertical ordinate axis in millibar (mbar). The total air mass flow m*tot that is between approximately 80 kg/h and 760 kg/h in the arrangement used as an example is plotted along the horizontally extending abscissa axis in kilogram per hour (kg/h). The pressure losses dptot and dpsek each progressively increase with increasing total air mass flow m*tot. The total pressure loss dptot assumes values between approximately 0 mbar and approximately 15 mbar. The secondary pressure loss dpsek assumes values between somewhat above 0 mbar and approximately 3 mbar.

Moreover, in the diagram of FIG. 2 the dependency of the secondary air mass flow m*sek through the secondary intake line 26 (upper curve) on the total air mass flow m*tot is illustrated. The secondary air mass flow m*sek is illustrated in FIG. 2 along the right vertical ordinate axis in kg/h. The secondary air mass flow m*sek increases with increasing total air mass flow m*tot. It assumes values between approximately 2.5 kg/h and approximately 25 kg/h. In FIG. 2, it is illustrated that, for example, for a total air mass flow m*tot of approximately 760 kg/h a secondary air mass flow m*sek of only approximately 25 kg/h is aspirated through the secondary intake line 26. The proportion of the secondary air mass flow m*sek is approximately 1/30th of the total air mass flow m*tot. The admixture of the heated secondary combustion air to the primary combustion air in normal operation is thus nearly prevented.

Figure 3:
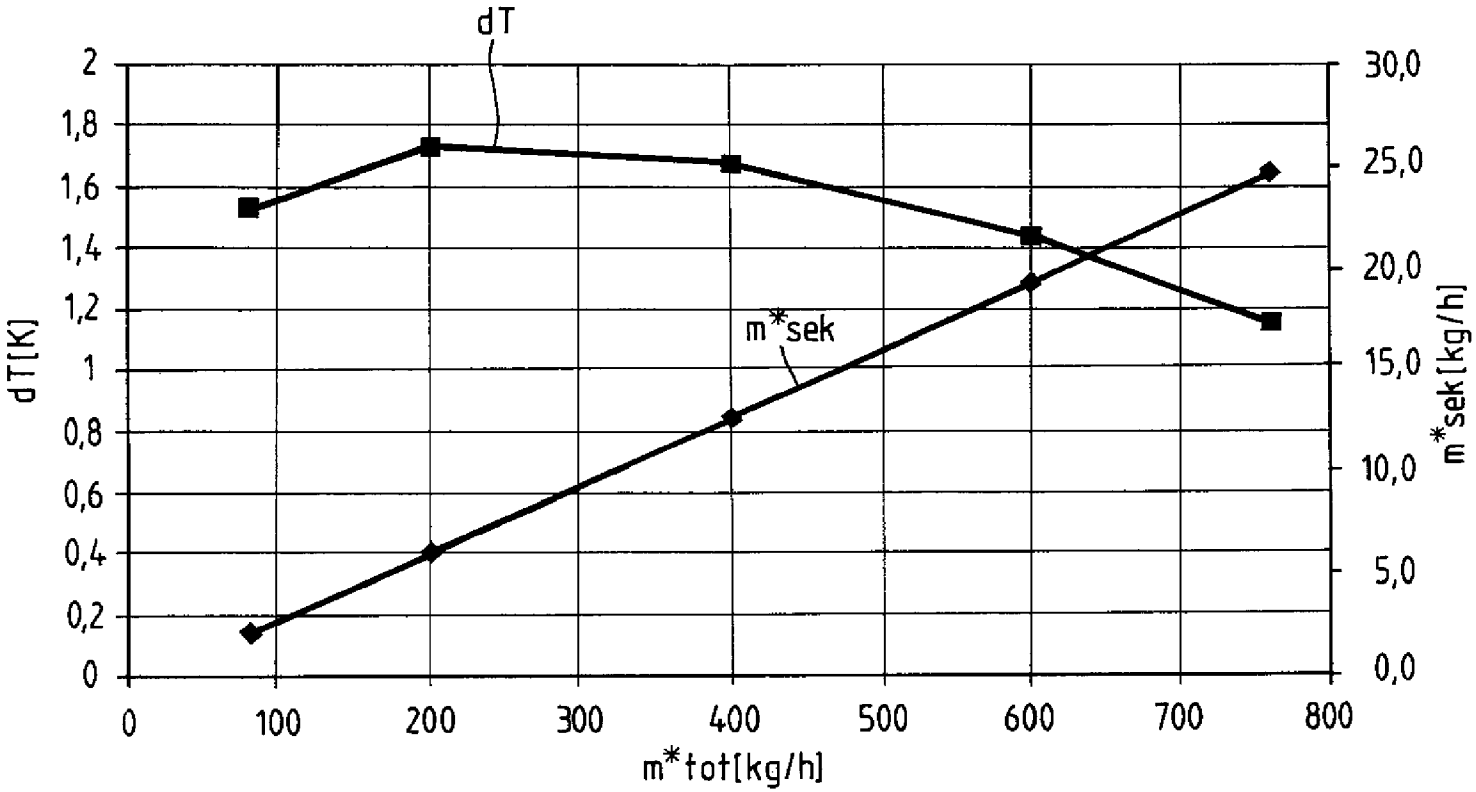
FIG. 3 shows schematically in a diagram a temperature change in the total air mass flow and the secondary pressure loss as a function of the total air mass flow through the intake device of FIG. 1 when the primary intake line is open.

The diagram of FIG. 3 shows in an exemplary fashion for the open primary intake line 24 a temperature change dT (upper curve) of the total combustion air and the secondary air mass flow m*sek (lower curve) as a function of the total air mass flow m*tot in the partial load ranges of the internal combustion engine illustrated in FIG. 2. The temperature change dT is illustrated in FIG. 3 along the left vertical ordinate axis in Kelvin (K). The secondary air mass flow m*sek is illustrated along the right vertical ordinate axis in kg/h. The total air mass flow m*tot in kg/h is illustrated on the horizontally extending abscissa axis. In the illustrated embodiment the temperature of the secondary combustion air is approximately 80 degrees Celsius. The temperature of the primary combustion air is approximately 20 degrees Celsius. The diagram illustrates that the temperature change dT has values between approximately 1.15 K and approximately 1.75 K. Under other boundary conditions, for example, when the secondary combustion air has a temperature of less than approximately 80 degrees C., also temperature changes dT of the total combustion air of less than 1.15 K can be achieved.

Figure 4:
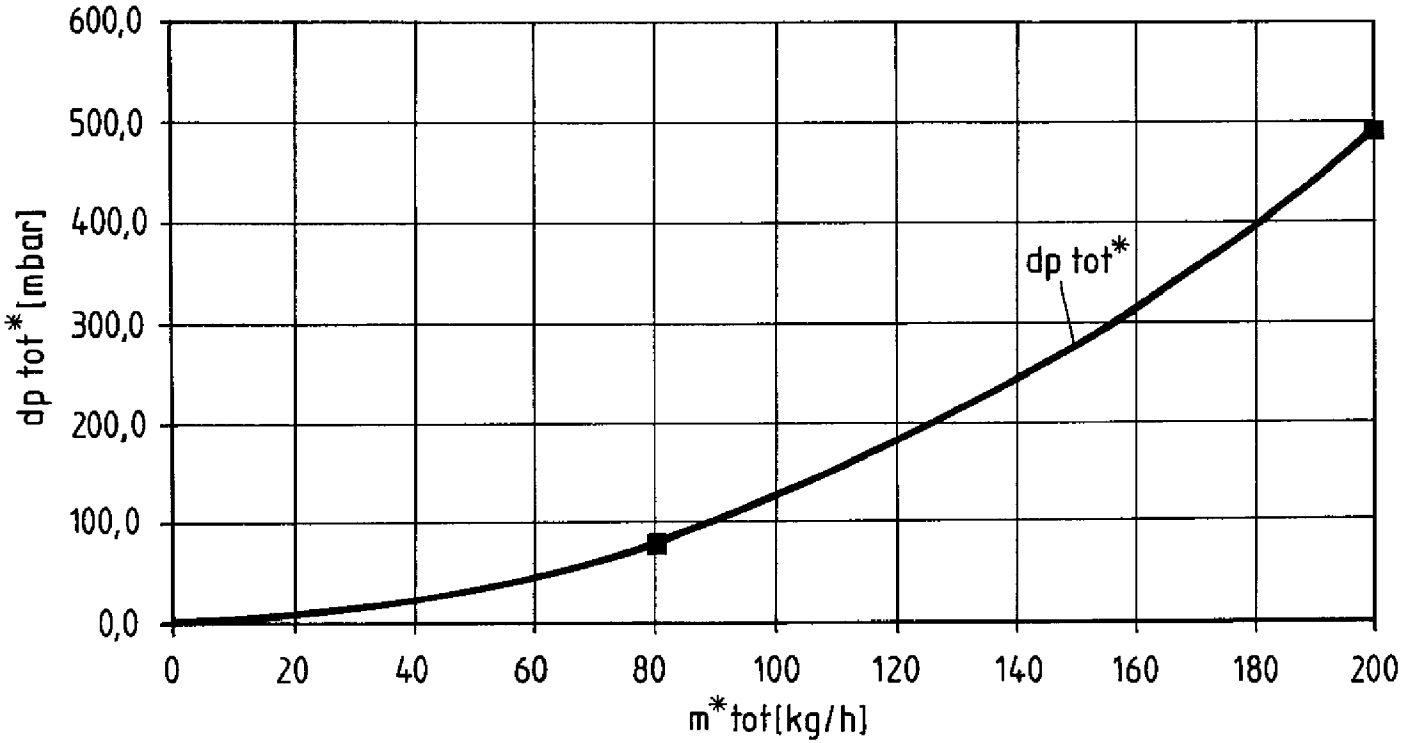
FIG. 4 shows schematically in a diagram the total pressure loss as a function of the total air mass flow through the intake device of FIG. 1 when the primary intake line is closed.

The diagram of FIG. 4 shows in an exemplary fashion a total pressure loss dptot* as a function of the total air mass flow m*tot when the primary intake line 24 is closed or clogged. The total pressure loss dptot* is illustrated in FIG. 4 along the left vertical ordinate axis in mbar. The total air mass flow m*tot is illustrated along the horizontally extending abscissa axis in kg/h. The total pressure loss dptot* progressively increases with increasing total air mass flow m*tot. In the total air mass flow m*tot of approximately 80 kg/h the total pressure loss dptot* is approximately 78.3 mbar. It has been found that in the described embodiment a total pressure loss dptot* of up to 250 mbar can be realized without the engine "dying".

In all of the above described embodiments of an intake device 10, the following modifications are possible inter alia.

The invention is not limited to an intake device 10 of internal combustion engines of motor vehicles. Instead, it can also be used in other internal combustion engines, for example, in industrial motors.

For realizing the function in accordance with the invention, in comparison to the primary intake line 24 the secondary intake line 26 can also be designed differently with regard to the configuration (shape and/or size) in other ways than by being modified in regard to length and cross-section.

Depending on the configuration of the secondary intake line 26 and/or the design of the internal combustion and/or the operating conditions, the secondary inlet chamber 32 may be eliminated. The secondary intake line 26 can then extend into the primary inlet chamber 18.

The filter medium of the filter element 16, instead of being made of an isotropic porous material, can be made of a different kind of material that is suitable for filtration of air.

The temperature of the secondary combustion air can also be lower or higher than 80 degrees Celsius.

The primary combustion air can also be significantly warmer or colder than 20 degrees Celsius.

The proportion of the secondary air mass flow m*sek when the primary intake line 24 is open may be more or less than 1/30th of the total air mass flow m*tot.

The total air mass flow m*tot may also be less than 80 kg/h or more than 760 kg/h.

The values for the total pressure loss dptot, the secondary pressure loss dpsek, and the secondary air mass flow m*sek may be also greater or smaller, for example, depending on the type of the internal combustion and/or the environmental conditions and/or the design of the intake device 10.

While specific embodiments of the invention have been shown and described in detail to illustrate the inventive principles, it will be understood that the invention may be embodied otherwise without departing from such principles.

What is claimed is:

1. An intake device of an internal combustion engine, the intake device comprising:

a primary intake line for aspirating primary combustion air;

a secondary intake line for aspirating secondary combustion air;

an air filter housing comprising a primary inlet chamber and a secondary inlet chamber and having an exterior;

wherein said primary intake line opens into said primary inlet chamber;

wherein a secondary intake port is arranged exterior to the filter housing and remotely from the filter housing and positioned in an engine compartment at a location to access heated secondary combustion air aspirated through said secondary intake port having a temperature of greater than 0 degrees Celsius that is sufficient to prevent loading of said secondary intake line with snow or ice;

wherein the secondary intake port is connected to the secondary inlet chamber by the secondary intake line, the secondary intake line has a first end secured onto the filter housing and opens into said secondary inlet chamber;

the secondary intake line extending outwardly away from the exterior of the housing and terminating at the secondary intake at a second end opposing the first end;

wherein, in comparison to said primary intake line, said secondary intake line has a configuration such that, in normal operation of the internal combustion engine, a flow capacity of said secondary intake line in comparison to a flow capacity of said primary intake line is so minimal that said secondary combustion air taken in through said secondary intake line has a negligible effect on the performance of the internal combustion engine;

wherein the secondary line has cross section that is sized and configured such that in normal operation the secondary intake line contributes less than 5% of the total mass air flow delivered to the engine;

wherein due to the minimal flow configuration, the secondary intake line does not include a valve and is continuously open providing airflow to the secondary inlet chamber;

wherein, when said primary intake line is closed, said flow capacity of said secondary intake line suffices to supply the internal combustion engine with a minimum combustion air mass flow required for operating the internal combustion engine.

2. The intake device according to claim 1, wherein said secondary inlet line has a secondary inlet port and said secondary inlet port is arranged so as to be protected from external influences that may cause closure of said secondary intake line.

3. The intake device according to claim 2, wherein said secondary inlet port is arranged so as to be protected from external influences in the form of snow, water, and dirt.

4. The intake device according to claim 2, wherein said temperature is approximately 80 degrees Celsius.

5. The intake device according to claim 1, wherein said configuration of said secondary intake line is determined such that, in normal operation of the internal combustion engine, a secondary pressure loss in said secondary intake line in comparison to a total pressure loss of the intake device is so large that aspiration of said secondary combustion air through said secondary intake line is nearly prevented.

6. The intake device according to claim 5, wherein said configuration encompasses at least one of a length and a cross-section of said secondary intake line.

* * * * *